US009093770B2

(12) United States Patent
Mumper et al.

(10) Patent No.: US 9,093,770 B2
(45) Date of Patent: Jul. 28, 2015

(54) CONNECTOR ELEMENT HAVING SECOND CONTACT SECURING MEANS

(75) Inventors: Guenther Mumper, Egelsbach (DE); Konrad Helmut Roth, Fr-Crumbach (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 14/112,494

(22) PCT Filed: Apr. 10, 2012

(86) PCT No.: PCT/EP2012/056441

§ 371 (c)(1),
(2), (4) Date: Oct. 17, 2013

(87) PCT Pub. No.: WO2012/143259

PCT Pub. Date: Oct. 26, 2012

(65) Prior Publication Data

US 2014/0045363 A1 Feb. 13, 2014

(30) Foreign Application Priority Data

Apr. 18, 2011 (DE) ..... 10 2011 002 135

(51) Int. Cl.
*H01R 13/424* (2006.01)
*H01R 13/422* (2006.01)
(Continued)

(52) U.S. Cl.
CPC ..... *H01R 13/424* (2013.01); *H01R 13/4223* (2013.01); *H01R 13/4361* (2013.01); *H01R 13/501* (2013.01)

(58) Field of Classification Search
CPC ..... H01R 13/4223; H01R 13/4365; H01R 13/4364; H01R 13/4362; H01R 13/4361
USPC ..... 439/595, 752
See application file for complete search history.

(56) References Cited

U.S. PATENT DOCUMENTS 5,820,410 A * 10/1998 Genta et al. ..... 439/595
7,563,135 B2 * 7/2009 Takahashi et al. ..... 439/595
(Continued)

FOREIGN PATENT DOCUMENTS

EP 1176670 A1 1/2002

OTHER PUBLICATIONS

International Search Report and Written Opinion issued by the European Patent Office, dated Jun. 13, 2012, for related International Application No. PCT/EP2012/056441; 12 pages.
(Continued)

*Primary Examiner* — Gary Paumen
(74) *Attorney, Agent, or Firm* — Faegre Baker Daniels LLP

(57) ABSTRACT

An electrical connector element having at least one contact receiving member for an electrical contact element which can be inserted in an insertion direction (E) as far as its end position (F) into the at least one contact receiving member, having a locking member by means of which the contact element in its locking position (L) can be secured in the end position (F) against being removed from the at least one contact receiving member counter to the insertion direction (E), and having a securing member which retains the locking member in the locking position (L) in its securing position (B). In order to better secure the contact elements against being removed from the contact receiving members, there is provision according to the invention for the securing member in the securing position (B) to at least partially protrude into the at least one contact receiving member and consequently for the contact element to be able to be additionally secured against being removed from the at least one contact receiving member counter to the insertion direction (E).

16 Claims, 3 Drawing Sheets

(51) Int. Cl.
*H01R 13/436* (2006.01)
*H01R 13/50* (2006.01)

(56) References Cited

U.S. PATENT DOCUMENTS 7,654,865 B2 * 2/2010 Chazottes et al. ..... 439/595
2006/0052004 A1 3/2006 Yamashita
2009/0186523 A1 * 7/2009 Campbell et al. ..... 439/595

OTHER PUBLICATIONS

International Preliminary Report on Patentability issued by The International Bureau of WIPO, Geneva, Switzerland, dated Oct. 22, 2013, for related International Application No. PCT/EP2012/056441; 8 pages.

* cited by examiner

CONNECTOR ELEMENT HAVING SECOND CONTACT SECURING MEANS

BACKGROUND OF THE INVENTION

The present invention relates to an electrical connector element, in particular as part of an electrical plug type connector, having at least one contact receiving member for an electrical contact element which can be inserted into the at least one contact receiving member in an insertion direction as far as its end position, having a locking member by means of which the contact element in its locking position can be secured in the end position against being removed from the at least one contact receiving member counter to the insertion direction, and having a securing member which retains the locking member in the locking position in its securing position.

Such connector elements are known from the prior art. For example, the specification U.S. Pat. No. 6,024,605 discloses an "inline" connector element, that is to say, a so-called 180° connector, in which locking members in the form of resiliently deflectable catches or catch plates are retained in their locking position by means of a cover which is connected to a housing member of the connector element by means of a type of integral hinge.

Furthermore, the specification U.S. Pat. No. 5,100,345 A discloses a connector element of the generic type, in which catch members for the contact elements are secured in the locking position by means of a cover which is constructed so as to be able to be displaceably fitted to the housing member.

A disadvantage with connector elements known from the prior art is that an additional, so-called second contact securing means, which supplements the contact primary engagement brought about by the locking members and may help to check correct seating of the contact elements in their end positions, is possible only with difficulty.

BRIEF SUMMARY OF THE INVENTION

Taking into account these disadvantages, an object of the present invention is to better protect the contact elements from being removed from the contact receiving members and to facilitate checking of correct seating of the contact elements in their end position.

This object is achieved according to the invention by the securing member in the securing position at least partially protruding into the at least one contact receiving member in order to additionally secure the contact element against being removed from the at least one contact receiving member counter to the insertion direction. That is to say, the contact element can additionally be secured directly to the securing member.

This solution has the advantage that the securing member can perform an additional function, by acting as a second contact securing means. Furthermore, the position of the contact element can be checked using the securing member. The securing member may also help to secure the primary engagement brought about by the securing member. It is further possible to increase contact removal forces required to pull the contact elements out counter to the insertion direction, for example, by reaching behind a retention portion of the contact elements, the so-called contact box.

The solution according to the invention can be freely combined and further improved with the following additional embodiments which are each advantageous per se.

There may thus be provision according to a first advantageous embodiment for the securing member to extend in the securing position at least partially through an aperture into the at least one contact receiving member and to overlap therewith in a projection in the insertion direction. Via the aperture, the securing member can be moved into the contact receiving member in a particularly simple manner and, for example, extend from outside the connector element through the aperture laterally and/or from above into the contact receiving member. The aperture may thus provide lateral and/or vertical access to the contact receiving member. Owing to the overlapping with the contact receiving member, the cross-section thereof may be reduced at any desired location in such a manner that, in the region of the cross-section reduction, the contact element is blocked.

A blocking or additional locking of the contact element in the end position can be produced in a simple manner by the securing member, at least in the securing position, protruding into the at least one contact receiving member counter to a vertical direction extending transversely relative to the insertion direction and/or in a transverse direction of the connector element extending both transversely relative to the vertical direction and transversely relative to the insertion direction.

Depending on the orientation of an actuation path of the locking member, there may be provision for the securing member in the securing position to laterally support the locking member transversely relative to the insertion direction. In the present instance, a lateral support means that an actuation path or resilient path of the locking member extends substantially parallel with the vertical direction and the locking member is supported transversely relative to the actuation path. Consequently, the locking member can be secured against lateral movements, or laterally retained, which increases the rigidity of the locking and helps to prevent damage to the locking member.

A fixing or securing of the contact element in the end position that supplements the securing of the contact element by the securing member can be achieved by a securing portion of the securing member in the securing position being able to be arranged in the end position in the insertion direction upstream of a retention portion of at least one contact element. The retention portion or the contact box may, for example, be used both by the locking member and by the securing member in order to secure the contact element. It is not absolutely necessary in this instance for the locking member and retention member to be arranged at the same height in the insertion direction. Alternatively, the securing member or the securing portion thereof may be arranged, for example, slightly offset in the insertion direction upstream of the locking member so that the securing member is carried only when the locking member fails.

A portion which secures the locking member and/or securing member may perform another function by a catch element on the securing member in the securing position being able to engage with a counter-catch element of the connector element that adjoins the at least one contact receiving member. The catch element may, for example, be formed on or as a securing portion of the securing member which may, for example, have a hold-down member for the locking member, a locking face for the contact element, a catch projection and/or a blocking element for preventing premature assembly of connector elements which are not correctly provided with contact elements.

The securing member may, at least in the securing position, be in alignment with an outer wall portion of the connector element. On the one hand, portions of the securing member which protrude from the connector element can consequently be prevented from becoming damaged or making the handling thereof more difficult. On the other hand, a portion of the securing member that acts as a blocking element may protrude above the wall portion in a preliminary securing position in order to prevent premature assembly of connector elements which are not correctly provided with contact elements. In the securing position, this blocking element may be embedded in the connector element in such a manner that it allows assembly of the connector element and mating connector element.

Another possibility for protecting the securing member or the securing thereof to the connector element from damage involves a portion of the connector element for fitting the securing member being directed in the insertion direction and/or extending transversely relative to an outer wall portion of the connector element. Consequently, optionally when handling the connector element, in particular when a blocking element of the securing member in the preliminary securing position prevents assembly with a mating connector, forces acting on the connection can be better transmitted from the securing member to the housing member.

The securing member may advantageously be connected to the housing member in a simple manner by being hinged thereto. This allows the securing member to be fitted to the housing member in a non-releasable manner. The securing member and housing member may also be constructed integrally in this manner.

In particular when the securing member is hinged to the housing member, the hinge may be protected from damage by the securing member being connected to the connector element at a face of the connector element which is directed substantially in an insertion direction and/or in a connection direction of the connector element.

The invention is described in greater detail below by way of example with reference to possible embodiments and the appended drawings. The feature combinations illustrated in those embodiments are intended merely for purposes of illustration. Individual features may also be omitted in accordance with their advantages described above if the advantage of this feature is not important in specific applications. In the drawings:

DETAILED DESCRIPTION OF THE INVENTION

Figure 1:
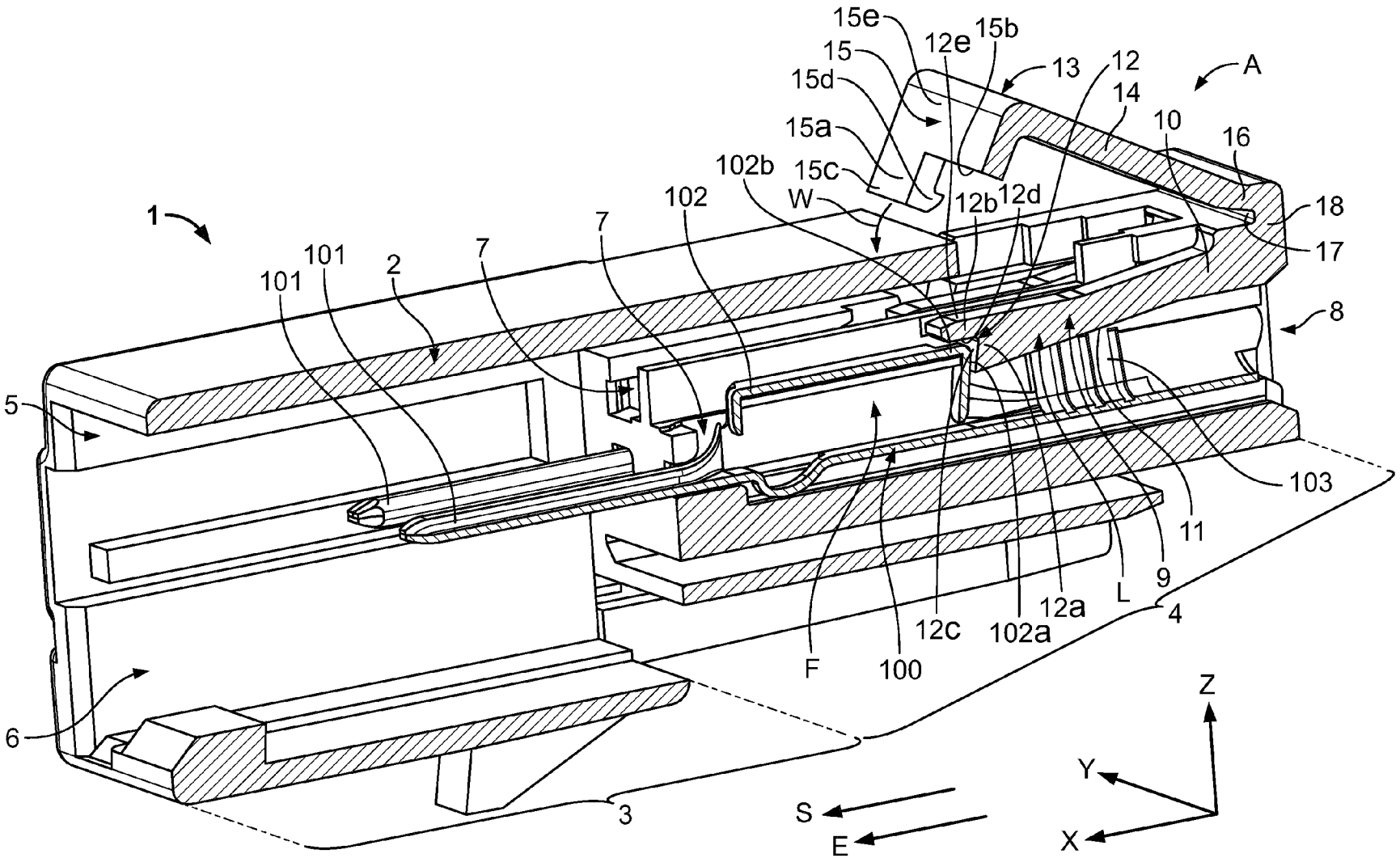
FIG. 1 is a schematic, perspective cross-section of a connector element according to the invention having a securing member in a preliminary securing position.

The structure of a connector element 1 according to the invention will first be explained with reference to the schematic, perspective cross-section thereof shown in FIG. 1. The connector element 1 has a housing member 2. An insertion portion 3 and a conductor receiving portion 4 are formed on the housing member 2. The insertion portion 3 is constructed so as to be able to be connected to a mating connector portion of a mating connector element (not shown). The connector element 1 and the mating connector element may be part of an electrical plug type connector.

A mating connector receiving member 6 which is accessible via an insertion opening 5 is formed in the insertion portion 3. In the mating connector receiving member 6 there are arranged two plug type contacts 101 in the form of pin contacts which are formed in each case on a contact element 100. The plug type contacts 101 extend substantially parallel with an insertion direction S of the connector element 1 which extends in the present embodiment substantially parallel with a longitudinal direction X of the contact element 1. In a transverse direction Y of the connector element that extends transversely to the longitudinal direction X, two contact elements 100 are arranged beside each other in the present example. The longitudinal direction X and transverse direction Y both extend substantially transversely relative to a vertical direction Z of the connector element 1.

The contact elements 100 are each retained in a contact receiving member 7 which is formed in the conductor receiving portion 4. To this end, a retention portion 102 is formed in each case on the contact elements 100. Furthermore, the contact elements 100 each have a conductor securing portion 103 for securing an electrical conductor (not illustrated) to the contact element 100. Via a contact insertion opening 8, the contact element 100 can be inserted into its contact receiving member 7 in an insertion direction E which extends substantially parallel with the longitudinal direction X with the plug type contact 101 at the front. The retention portion 102 passes a locking member 9 of the connector element 1.

The locking member 9 protrudes into the contact receiving member 7 in a locking position L transversely relative to the longitudinal extent of the contact receiving member 7 that extends substantially parallel with the longitudinal direction X, in the present case counter to the vertical direction Z. During the introduction of the contact element 100, the locking member 9 is redirected in the vertical direction Z owing to resilient securing to the connector element in the region of a lower member 10 of the locking member 9. For ease of redirection, there is formed on the locking member 9 a slightly inclined leading member 11 which extends substantially from the lower member 10 to a locking zone 12 of the locking member 9.

The locking zone 12 comprises a catch portion **12*a* and a hold-down portion 12*b*. The catch portion 12*a* is formed as a catch projection whose catch face 12*a* which is directed substantially in the insertion direction E abuts an engagement region 102*a* of the contact element 100 that is formed on the retention portion 102 and is directed substantially counter to the insertion direction E in an end position F of the contact element 100 shown in FIG. 1. The engagement region 102*a* is formed as a face or corner on the retention portion 102. A hold-down face 12*b* on the hold-down portion 12*b* is, at least in the end position F, arranged in a vertical direction Z above a hold-down region 102*b* that is formed on the retention portion 102. By the hold-down region 102*b* being arranged below the hold-down portion 12*b*, which may abut the hold-down region 102*b* or at least be arranged in the vicinity thereof, the contact element 100** is fixed or secured in the vertical direction Z.

Furthermore, the connector element 1 has a securing member 13 which can be secured as in the present case to the conductor receiving portion 4. The securing member 13 has an actuation portion 14 and a securing portion 15. The actuation portion 14 in the form of a type of lever, whose outer side provides an actuation face for applying an actuation force, is secured to a face 17 which is formed on the housing member 2 by means of a lower member of the securing member 13 intended to form a hinge 16 and which is directed substantially in the connection and insertion direction S or E. The securing member 13 is connected in a rotationally movable manner to the housing member 2 by means of the hinge 16.

Consequently, the securing portion 15 can be moved along a substantially circular actuation path W from the preliminary securing position A of the securing member 13 which is shown here and in which the securing portion 15 is moved out of engagement with the contact receiving member 7, into a securing position B (see FIGS. 2 and 3) of the securing member 13. The face 17 is formed on a continuation 18 which extends in a vertical direction Z away from the housing member 2.

The securing portion 15 is fitted to the actuation portion 14 so as to bend substantially at a right angle from the actuation portion 14 so that the securing portion 15 can extend away from the actuation portion 14 counter to the vertical direction Z as soon as it extends substantially parallel with the longitudinal direction X in the securing position B. The securing portion 15 comprises a catch element 15*a* and a hold-down member 15*b*. The catch element 15*a* carries out a dual function in that it has a locking face 15*c* and a catch projection 15*d*. The locking face 15*c* is constructed to sit in the securing position B in the insertion direction E upstream of the engagement region 102*a* of the contact element 100 in order, in addition to the catch face 12*c*, to be able to secure the contact element 100 against movements counter to the insertion direction E. The catch projection 15*d* is in turn constructed so as to co-operate with a counter-catch element (not yet illustrated in this instance) on the housing member in order to engage the securing member 13 in the securing position B.

Furthermore, the securing portion 15 provides a blocking element 15*e* in the form of a surface which may prevent complete connection of the connector element 1 with a mating connector element as long as the securing member 13 is in the preliminary securing position A. To this end, the mating connector element may, for example, be constructed in such a manner that an interrogation region, for example, an edge of a mating connector opening, strikes the blocking element 15*e* as long as it is not moved into the securing position B. This may signal, for example, that the contact element 100 has not been moved completely into the end position F, whereby the locking zone 12 could be moved upwards out of the contact receiving member 7. Consequently, the hold-down member 15*b* would rest on an actuation face 12*e* of the locking zone 12 or be blocked thereby and prevent a movement of the securing member 13 from the preliminary securing position A into the securing position B.

Figure 2:
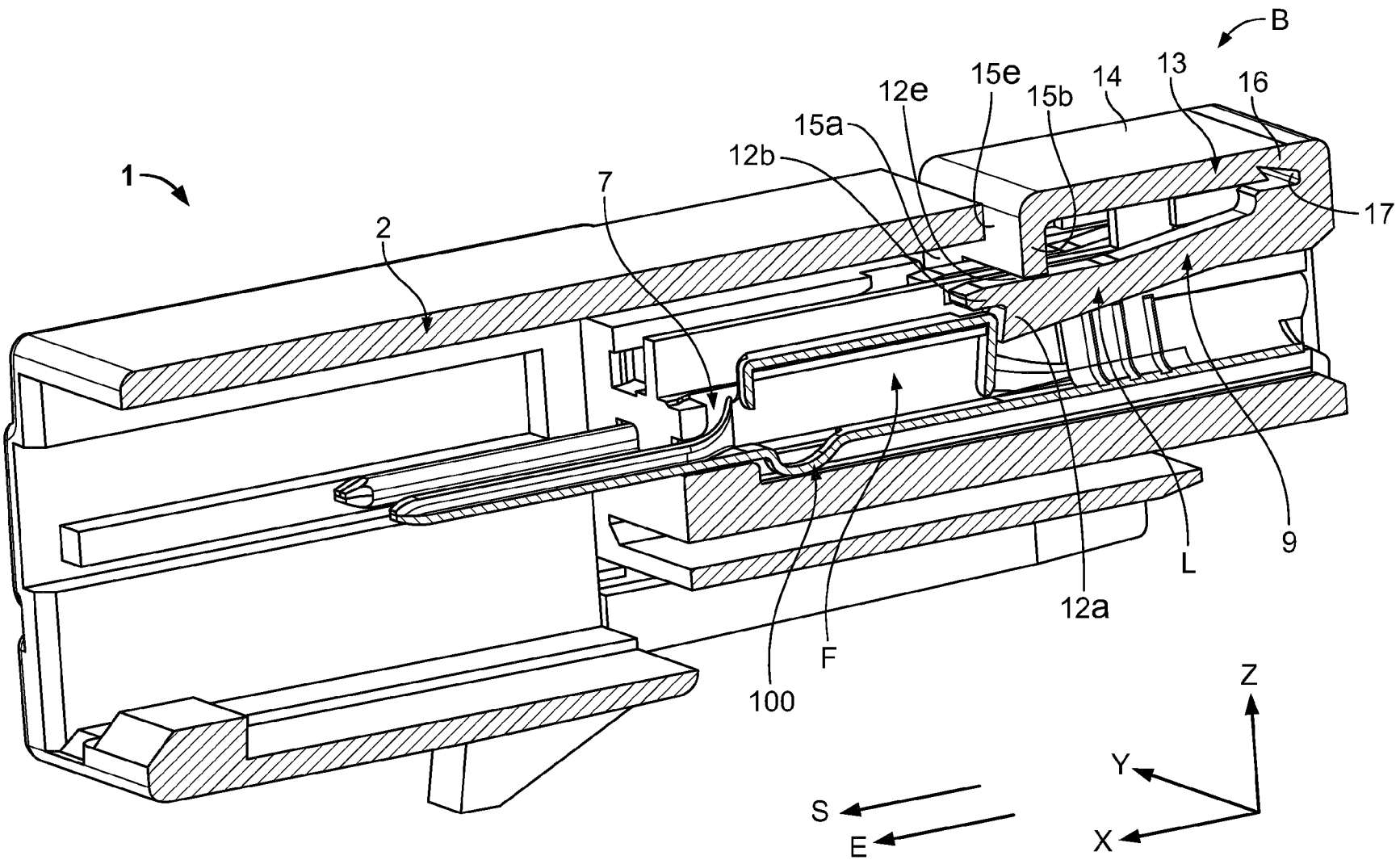
FIG. 2 is a schematic, perspective cross-section of the connector element illustrated in FIG. 1 with the securing member in a securing position.

FIG. 2 illustrates the connector element 1 with two contact elements 100 which are each in the end position F and which are locked in their contact receiving members 7 by means of the locking members 9. The locking members 9 are secured by the securing member 13 which has been moved from the preliminary securing position A into the securing position B in the locking position L. In order to secure the locking members 9 in the locking position L, the hold-down member 15*b* rests on the actuation face 12*e* or is at least arranged with small spacing therefrom and consequently prevents the locking member 9 from being moved upwards out of the locking position L. In addition, the securing member 13 secures the locking members 9 in each case laterally in the transverse direction Y by the two catch elements 15*a* which are formed as securing members 13 each being arranged next to the locking members 9.

Figure 3:
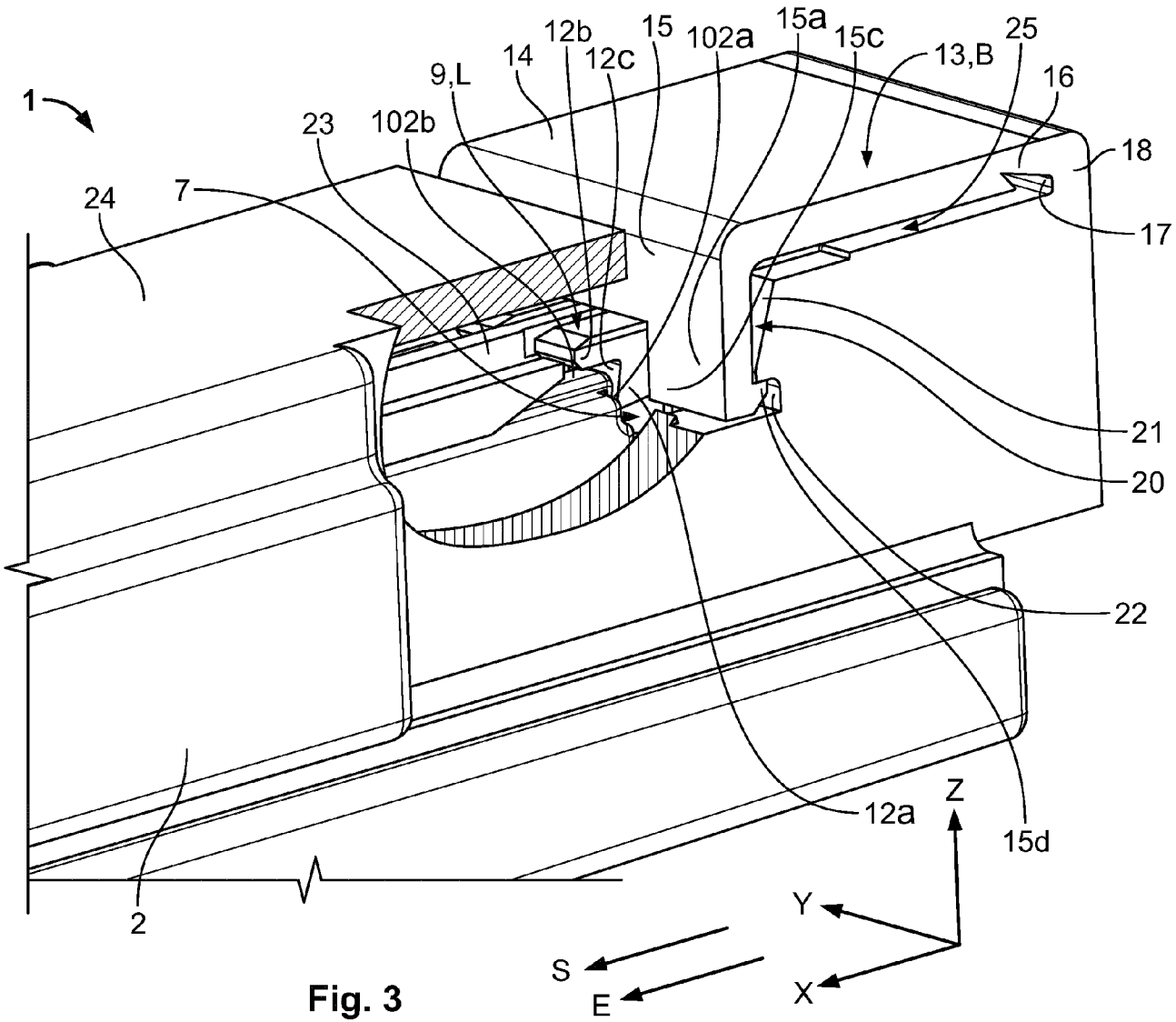
FIG. 3 is a schematic, perspective detailed view of the connector element shown in FIGS. 1 and 2, which is partially sectioned in the region of engagement of the securing member in a contact receiving member of the connector element.

FIG. 3 illustrates how one of the two catch elements 15*a* is arranged beside one of the locking members 9. The securing portion 15 thus protrudes with the catch element 15*a* into an aperture 20 which extends from outside the housing member 2 into the contact receiving member 7. The aperture 20 is provided with an inclined starting member 21. The inclined starting member 21 facilitates movement of the securing member 13 from the preliminary securing position A into the securing position B by the catch projection 15*d* being guided along the inclined starting member, the securing portion 15 being resiliently redirected until the catch projection 15*d* snap-fits at the lower end of the inclined starting member into a counter-catch element 22 in the form of a catch opening formed on the housing member 2 and secures the securing member 9 in the securing position B by means of engagement. The portion of the securing portion 15 that forms the catch element 15*a* is pushed beside the locking member 9 in the locking position L. Parallel with the transverse direction Y, the locking member 9 is now locked between the securing portion 15 and a partition wall 23. The partition wall 23 is formed on the housing member 2 and separates the two contact receiving members 7 from each other.

Furthermore, the locking face 15*c* is arranged in the insertion direction E upstream of the engagement region 102*a* of the contact element 100 and, in addition to the catch face 12*c* of the locking member 9, prevents the contact element 100 from being pulled counter to the insertion direction E from its contact receiving member 7. Furthermore, the actuation portion 14 of the securing member 13 is in alignment in the securing position B with an upper wall portion 24 of the housing member. That is to say, the actuation portion 14 is received in a recess 25 on the housing member.

In the context of the notion of the invention, deviations from the embodiments described above are possible. For instance, the insertion portion 3 may have the requirements in accordance with a connector opening 5 and a mating connector receiving member 6 or, for example, be formed as a connector for insertion. The contact elements may form the pin contacts or socket contacts illustrated in this instance as plug type contacts 101. The conductor receiving portion 4 may have any number of contact receiving members 7 with contact insertion openings 8 which are formed so as to fit respective contact elements 100. Consequently, the number of locking members 9 may vary in accordance with the number of contact receiving members 7. The locking members 9 may be formed in accordance with the respective requirements and be resiliently connected to the housing member 2 by means of lower members 10.

The securing member 13 may be adapted to the configuration of the locking members 9. It is advantageous for the securing member 13 to be constructed as illustrated herein to secure a plurality of locking receiving members 9 by protecting them, together with its hold-down member 15*b*, against movements in the vertical direction Z and laterally fixing or securing them at the same time with two portions of its securing portion 15 that are arranged at both sides of the locking members 9, for example, as shown in this instance, by the catch elements 15*a*. It is further advantageous, but not absolutely necessary, for the contact receiving members 7, the locking members 9 and the securing member 13 to be integrally formed on the housing member 2, that is to say, as integral components thereof.

A configuration according to the invention of a connector element 1 is not limited to the 180° variant described herein, but can also be used with angled connectors in which, for example, the insertion direction E is bent counter to the connection direction S.

REFERENCE NUMERALS

1 Connector element
2 Housing member
3 Connector portion
4 Conductor receiving portion

5 Insertion opening
6 Mating connector receiving member
Conductor fixing portion
7 Contact receiving member
8 Contact insertion opening
9 Locking member
10 Lower member of the locking member
11 Inclined leading member
12 Locking zone
12*a* Catch portion
12*b* Hold-down portion
12*c* Catch face
12*d* Hold-down face
12*e* Actuation face
13 Securing member
14 Actuation portion
15 Securing portion
15*a* Catch element
15*b* Hold-down member
15*c* Locking face
15*d* Catch projection
15*e* Blocking element
16 Hinge
17 Surface
18 Continuation
19 Aperture
20 Inclined starting member
22 Counter-catch element
23 Partition wall
24 Upper wall portion
25 Recess
100 Contact element
101 Insertion contact
102 Retention portion
102*a* Engagement region
102*b* Hold-down region
103
A Preliminary securing position
B Securing position
E Insertion direction
F End position
L Locking position
S Connection direction
W Actuation path
X Longitudinal direction
Y Transverse direction
Z Vertical direction

The invention claimed is:

1. Electrical connector element having at least one contact receiving member for an electrical contact element which can be inserted into the at least one contact receiving member in an insertion direction (E) as far as its end position (F), having a locking member by means of which the contact element in its locking position (L) can be secured in the end position (F) against being removed from the at least one contact receiving member counter to the insertion direction (E), and having a securing member which retains the locking member in the locking position (L) in its securing position (B), wherein the securing member in the securing position (B), in order to additionally secure the contact element against being removed from the at least one contact receiving member counter to the insertion direction (E), at least partially protrudes into the at least one contact receiving member, wherein a catch element on the securing member in the securing position (B) is able to engage with a counter-catch element of the connector element that adjoins the at least one contact receiving member and in that the securing member has a locking face which is designed to secure the electrical contact element against being removed from the at least one contact receiving member counter to the insertion direction (E), the locking member has a catch face which in the securing position abuts a retention portion of the at least contact element and is directed substantially counter to the insertion direction (E), and wherein a securing portion of the securing member in the securing position (B) is arranged in the end position (F) in the insertion direction (E) upstream of a retention portion of at least one contact element.

2. The electrical connector element according to claim 1, wherein the securing member extends in the securing position (B) at least partially through an aperture into the at least one contact receiving member and overlaps therewith in a projection in the insertion direction (E).

3. The electrical connector element according to claim 1, wherein the securing member at least in the securing position (B) protrudes into the at least one contact receiving member counter to a vertical direction (Z) extending transversely relative to the insertion direction (E) and/or in a transverse direction (Y) of the connector element extending both transversely relative to the vertical direction (Z) and transversely relative to the insertion direction (E).

4. The electrical connector element according to claim 1, wherein the securing member in the securing position (B) laterally supports the locking member transversely relative to the insertion direction (E).

5. The electrical connector element according to claim 1, wherein the securing member at least in the securing position (B) is in alignment with an outer wall portion of the connector element.

6. The electrical connector element according to claim 1, wherein a portion of the connector element for fitting the securing member is directed in the insertion direction (E).

7. The electrical connector element according to claim 1, wherein the securing member is hinged to a housing member of the connector element.

8. The electrical connector element according to claim 1, wherein the securing member is connected to the connector element at a surface of the connector element which is directed substantially in or counter to the insertion direction (E) and/or in a connection direction (S) of the connector element.

9. Electrical connector element having at least one contact receiving member for an electrical contact element which can be inserted into the at least one contact receiving member in an insertion direction (E) as far as its end position (F), having a locking member by means of which the contact element in its locking position (L) can be secured in the end position (F) against being removed from the at least one contact receiving member counter to the insertion direction (E), and having a securing member which retains the locking member in the locking position (L) in its securing position (B), wherein the securing member in the securing position (B), in order to additionally secure the contact element against being removed from the at least one contact receiving member counter to the insertion direction (E), at least partially protrudes into the at least one contact receiving member, wherein a catch element on the securing member in the securing position (B) is able to engage with a counter-catch element of the connector element that adjoins the at least one contact receiving member and in that the securing member has a locking face which is designed to secure the electrical contact element against being removed from the at least one contact receiving member counter to the insertion direction (E), and wherein the securing member in the securing position (B) laterally supports the locking member transversely relative to the insertion direction (E).

10. The electrical connector element according to claim 9, wherein the securing member extends in the securing position (B) at least partially through an aperture into the at least one contact receiving member and overlaps therewith in a projection in the insertion direction (E).

11. The electrical connector element according to claim 9, wherein the securing member at least in the securing position (B) protrudes into the at least one contact receiving member counter to a vertical direction (Z) extending transversely relative to the insertion direction (E) and/or in a transverse direction (Y) of the connector element extending both transversely relative to the vertical direction (Z) and transversely relative to the insertion direction (E).

12. The electrical connector element according to claim 9, wherein the securing member in the securing position (B) laterally supports the locking member transversely relative to the insertion direction (E).

13. The electrical connector element according to claim 9, wherein the securing member at least in the securing position (B) is in alignment with an outer wall portion of the connector element.

14. The electrical connector element according to claim 9, wherein a portion of the connector element for fitting the securing member is directed in the insertion direction (E).

15. The electrical connector element according to claim 9, wherein the securing member is hinged to a housing member of the connector element.

16. The electrical connector element according to claim 9, wherein the securing member is connected to the connector element at a surface of the connector element which is directed substantially in or counter to the insertion direction (E) and/or in a connection direction (S) of the connector element.

* * * * *